US006190461B1

(12) United States Patent
Alack

(10) Patent No.: US 6,190,461 B1
(45) **Date of Patent: *Feb. 20, 2001**

(54) SUGAR LIQUIFICATION SYSTEM AND PROCESS

(75) Inventor: Charles S. Alack, St. Louis, MO (US)

(73) Assignee: Semi-Bulk Systems, Inc., Fenton, MO (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/151,085

(22) Filed: Sep. 10, 1998

Related U.S. Application Data

(63) Continuation-in-part of application No. 08/958,915, filed on Oct. 28, 1997, now abandoned.

(51) Int. Cl.[7] ..... B01F 5/04; B01F 3/12

(52) U.S. Cl. ..... 127/22; 127/63; 137/602; 366/131; 366/132; 366/163.2

(58) Field of Search ..... 127/22, 63; 137/602; 366/131, 132, 163.2

(56) References Cited

U.S. PATENT DOCUMENTS

| | | | | |
|---|---|---|---|---|
| 4,186,772 | * | 2/1980 | Handleman | 137/604 |
| 4,860,959 | | 8/1989 | Handleman | 241/39 |
| 5,544,951 | * | 8/1996 | Alack | 366/163.2 |

FOREIGN PATENT DOCUMENTS

| | | | | |
|---|---|---|---|---|
| 009610455A1 | * | 4/1996 | (WO) | B01F/15/02 |
| 96/0455A1 | | 11/1996 | (WO) | B01F/15/02 |

OTHER PUBLICATIONS

Liquid Solids Control, Inc., "Process Refractometer Model 725 Brix, Spersaturation, and Seed Point Control," undated, pp. 1–5 (admitted prior art) no month avail.

Semi–Bulk System, Inc., "The Air–Pallet® Ejector–Mixer system," (1989,) no month avail. pp. 1–7.

(List continued on next page.)

*Primary Examiner*—David Brunsman
(74) *Attorney, Agent, or Firm*—Senniger, Powers, Leavitt & Roedel

(57) ABSTRACT

An eductor-mixer has a first inlet which receives dry particulate sugar from a sugar feed system and has a second inlet which receives a pressurized working liquid adapted to mix with the dry particulate sugar to form a liquified sugar solution. The eductor-mixer also has a discharge adapted for discharging the liquified sugar solution. A tank system receives the solution discharged from the eductor-mixer. A working fluid circuit conducts pressurized working fluid to the second inlet of the eductor-mixer and includes a solution recycle line for conducting solution from the tank system to the second inlet of the eductor-mixer, and a water supply line for adding water to the solution conducted to the second inlet of the eductor-mixer. A heater adds heat to the system to increase the temperature of the solution to a temperature at or above a specified temperature. A measuring device measures the sugar content of liquified sugar solution. A control system automatically adjusts the amount of sugar supplied to the first inlet of the eductor-mixer and/or the amount of water added to the solution supplied as working fluid to the second inlet of the eductor-mixer if the sugar content of the solution, as measured by the measuring device, is different from a target sugar content. A finished solution outfeed line transfers the finished solution from the tank system to a desired location when the sugar content of the solution is substantially at the target sugar content.

50 Claims, 11 Drawing Sheets

OTHER PUBLICATIONS

Semi–Bulk Systems, Inc., "Show in Print Dry & Liquid Handling Systems with Dairy in Mind," *Dairy Foods*®, Mid–(Oct. 1996) p. 33 (admitted prior art).

P. Lutz & C. Alack, "The Paint Plant for the 21$^{st}$ Century," Published (FEb., 1997), but the Dunn–Edwards installation Described therein was in public use prior to Oct. 28, 1996.

* cited by examiner

SUGAR LIQUIFICATION SYSTEM AND PROCESS

CROSS-REFERENCE TO RELATED APPLICATIONS

This application is a continuation-in-part of application Ser. No. 08/958,915, filed Oct. 28, 1997, now abandoned.

BACKGROUND OF THE INVENTION

This invention relates generally to the liquification of sugar and, more particularly, to a system which is capable of continuously mixing dry particulate sugar with a liquid, such as water, to form a liquid solution, and continuously pumping the solution to a location where it is stored or used.

Liquified sugar is commonly used in the food industry. Heretofore, liquification has been carried out using a batch process in which dry sugar is conveyed to a tank of hot liquid (e.g., hot water) and mechanically mixed with the liquid to form a batch of sugar solution. After the batch is finished, it is pumped from the tank, usually to a remote location for storage or use in a food processing operation. The process is then repeated to complete the next batch. This type of system has several drawbacks, including relatively slow liquification rates, high equipment costs, high wear on the conveying and mixing equipment due to the granular nature of the sugar, clogging of the dry sugar conveying equipment due to steam and moisture in the area of the mixing tank, high equipment maintenance costs, and other disadvantages.

SUMMARY OF THE INVENTION

Among the several objects of this invention may be noted the provision of a system and process for liquifying sugar on a "continuous" rather than "batch" basis to achieve higher liquification rates; the provision of such a system and process which has lower equipment costs; the provision of such a system and process which is easier and less costly to maintain than conventional systems; the provision of such a system and process which operates at lower temperatures; the provision of such a system and process in which the sugar concentration of the solution can be selectively varied according to need; the provision of such a system and process which can automatically adjust to the rate of dry sugar feed and/or water flow rate; the provision of such a system and process which recirculates liquified sugar thereby maintaining continuous and accurate control of the sugar concentration of the solution; and the provision of a continuous steady-state mixing system having applications other than the liquification of sugar, such as the mixing of ingredients used for beverages, pharmaceuticals, paper coating and filling, food, paints, inks, coatings, thickeners and catalyst mixes.

In general, a sugar liquification system of the present invention comprises an eductor-mixer, a tank system, a working fluid circuit, a heater, a measuring device, a control system and a finished solution outfeed line. The eductor-mixer has a first inlet for receiving dry particulate sugar from a sugar feed system, a second inlet for receiving a pressurized working liquid adapted to mix with the dry particulate sugar to form a liquified sugar solution, and a discharge adapted for discharging the solution. The tank system receives solution discharged from the eductor-mixer. The working fluid circuit conducts pressurized working fluid to the second inlet of the eductor-mixer. The working fluid circuit includes a solution recycle line for conducting solution from the tank system to the second inlet of the eductor-mixer and a water supply line for adding water to the solution conducted to the second inlet of the eductor-mixer. A heater adds heat to the system to increase the temperature of the solution to a temperature at or above a specified temperature. The measuring device measures the sugar content of the solution. The control system automatically adjusts the amount of sugar supplied to the first inlet of the eductor-mixer and/or the amount of water added to the solution supplied as working fluid to the second inlet of the eductor-mixer if the sugar content of the solution, as measured by the measuring device, is different from a target sugar content. The finished solution outfeed line conducts finished solution from the tank system to a desired location when the sugar content of the solution is substantially at the target sugar content.

A sugar liquification process of this invention comprises the steps of:

a) continuously feeding dry particulate sugar to a first inlet of an eductor-mixer, b) continuously pumping a pressurized working fluid including water to a second inlet of the eductor-mixer to enable mixing of the working fluid and the sugar in the eductor-mixer to form a liquified sugar solution, c) delivering solution from the eductor-mixer to a tank system, d) measuring the sugar content of solution discharged by the eductor-mixer and comparing the measured sugar content of the solution to a target sugar content, e) if the measured sugar content is different from the target sugar content, automatically adjusting the amount of sugar fed to the first inlet of the eductor-mixer and/or the amount of water in the working fluid fed to the second inlet of the eductor-mixer thereby to adjust the sugar content of the solution, and f) if the measured sugar content is substantially equal to the target sugar content, continuously conducting finished solution from the holding tank to a desired location.

Other objects and features will be in part apparent and in part pointed out hereinafter.

BRIEF DESCRIPTION OF THE DRAWINGS

Corresponding parts are designated corresponding reference characters throughout the several views of the drawings.

DETAILED DESCRIPTION OF PREFERRED EMBODIMENTS

Figure 1:
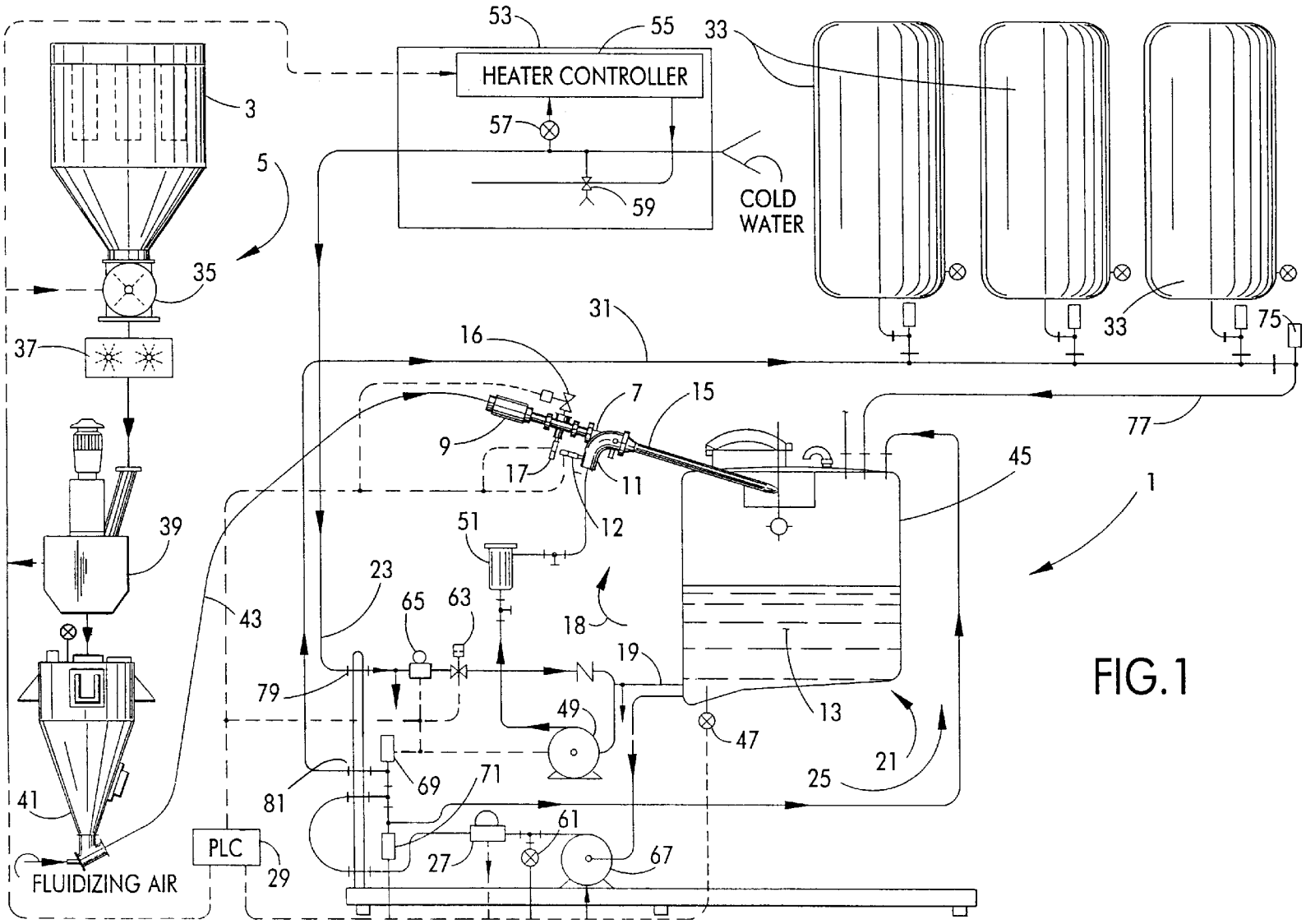
FIG. 1 is a schematic view of one preferred embodiment of a sugar liquification system of the present invention.

Referring now to the drawings, and first to FIG. 1, a sugar liquification system incorporating the present invention is indicated in its entirety by the reference numeral 1. In general, the system comprises a supply of dry particulate sugar in a hopper 3, a sugar feed system, generally designated 5, for feeding sugar from the supply, and an eductor-mixer 7 having a first inlet 9 for receiving dry particulate sugar from the sugar feed system 5, a second inlet 11 for receiving a pressurized working liquid solution 13 adapted to mix with the dry sugar to form a liquified sugar solution, a pressure sensor 12 for monitoring the pressure of the working liquid solution 13, and a discharge 15 for discharging the solution into a tank system generally indicated at 21. The eductor-mixer 7 also has a vacuum break valve 16 and a vacuum sensor 17 for sensing the vacuum at the inlet 9. The liquification system 1 also includes a working fluid circuit generally designated by an arrow 18 comprising a solution recycle line 19 for conducting solution from the tank system 21 to the second inlet 11 of the eductor-mixer 7, and a water supply line 23 for adding water to the working fluid solution 13 conducted by circuit 18 to the second inlet 11 of the eductor-mixer 7. A sugar content measuring circuit, or Brix circuit, generally designated by an arrow 25, is also provided. This circuit includes a Brix measuring device 27 for measuring the sugar content of solution 13 discharged into the tank system 21. If the sugar content of the solution, as measured by the Brix measuring device 27, is different from a target sugar content, a control system (to be described later) including a programmable logic controller (PLC) 29 automatically adjusts the amount of sugar supplied to the first inlet 9 of the eductor-mixer 7 and/or the amount of water added to the solution 13 supplied as working fluid to the second inlet 11 of the eductor-mixer 7. A finished solution outfeed line 31 is provided for conducting finished solution from the tank system 21 to a desired location (e.g., storage tanks 33) when the sugar content of the working fluid solution 13 is substantially at the target sugar content. The finished solution is conducted from the tank system 21 at a rate controlled by PLC 29 which maintains the level of the solution 13 in the tank at a predetermined set point or within a predetermined set range.

The various components of the overall system are described in greater detail below.

The sugar feed system 5 comprises a variable-speed drive rotary feeder 35 for feeding dry particulate sugar from the hopper 3 (or other source of sugar) at a selected rate controlled by PLC 29, and a delumper 37 downstream of the feeder for delumping the sugar to insure a uniform flow. The feed system 5 further comprises a sugar mass flow meter 39 for measuring the volume of sugar flow, and a fluidizing hopper cone 41 immediately downstream of the flow meter 39 for fluidizing the sugar with air for conveyance to the first inlet 9 of the eductor-mixer 7. The mass flow meter may be a Multicor Mass Flow Meter supplied by SCHENCK/ACCURATE of Whitewater, Wis. The fluidizing hopper cone 41 may be of the type described in co-assigned U.S. Pat. No. 4,848,975, incorporated herein by reference, and commercially available from Semi-Bulk Systems, Inc. of St. Louis, Mo. Sugar exiting the hopper cone 41 is conveyed to the eductor-mixer 7 via a sugar supply line 43. Other feed systems may be used to feed sugar to the eductor-mixer 7.

The eductor-mixer 7 (sometimes referred to as an ejector-mixer) is preferably of the type described in co-assigned U.S. Pat. No. 4,186,772, which is also incorporated herein by reference. The device has an internal mixing chamber in which dry sugar and working fluid solution are mixed to form a liquid sugar solution of desired concentration. The discharge 15 of the eductor-mixer may be in the form of a long discharge tube or nozzle. A suitable eductor-mixer 7 is commercially available from Semi-Bulk Systems, Inc. of St. Louis, Mo.

Preferably, the control system according to the invention includes a programmable logic controller (PLC) 29 such as a PLC Controller manufactured by Allen Bradley. However, it is contemplated that any type of control logic system may be used for controlling the system of the invention. For example, a microprocessor, digital logic circuitry, analog logic circuitry or a combination of all of these may be used to control the operation of the system of the invention. In FIG. 1, dashed lines are used to indicate input and output lines which interconnect the PLC 29 with various sensors, pumps, meters, valves, and other controls.

Figure 2:
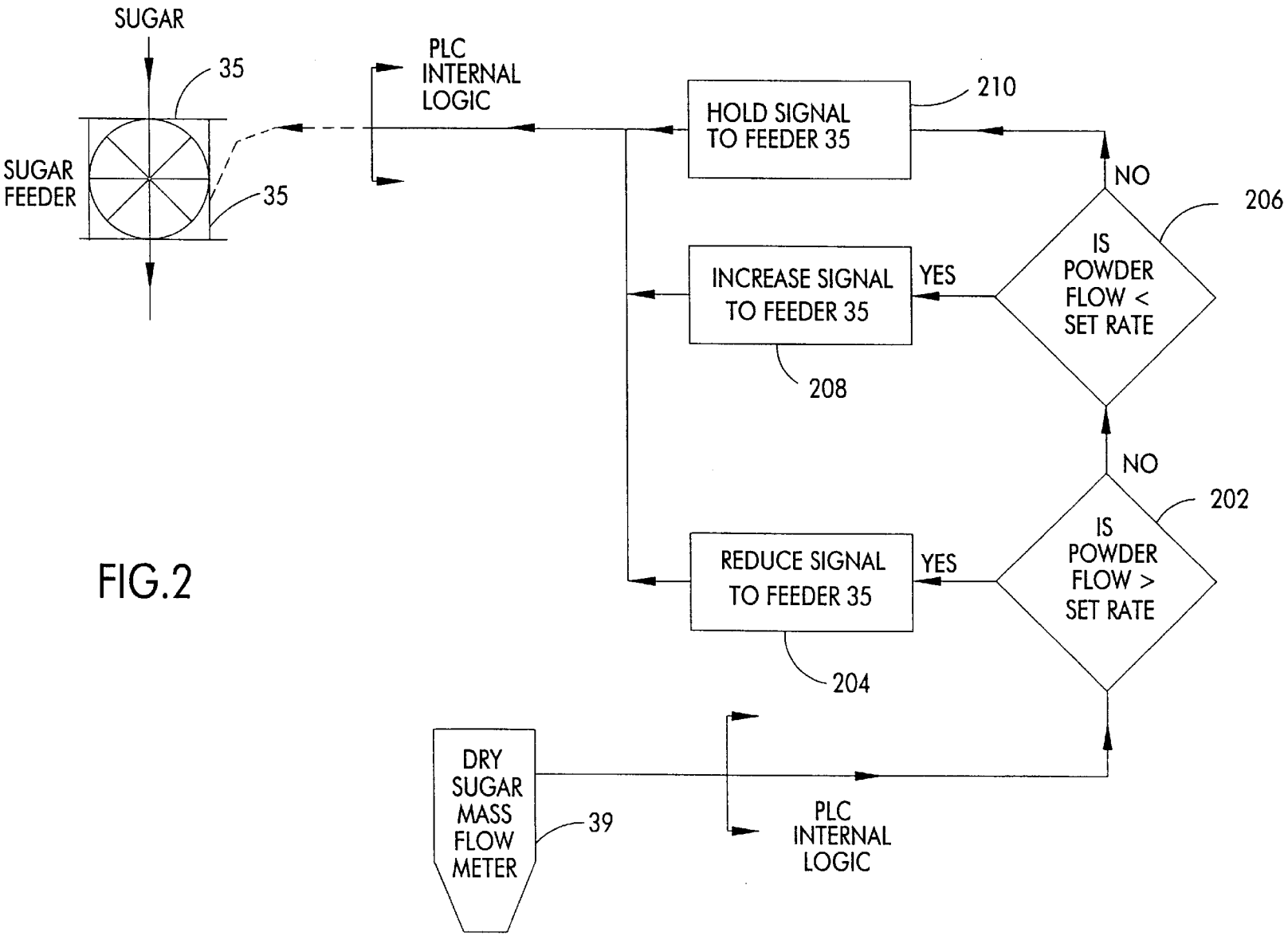
FIG. 2 is a diagram in block form illustrating one preferred embodiment of decision logic by which a controller may be programmed to control the sugar feed rate in the system of FIG. 1 of the present invention.

FIG. 2 is a diagram in block form illustrating one preferred embodiment of decision logic by which PLC 29 may be programmed to control the sugar feed rate in the system of FIG. 1. The rate at which dry particulate sugar is fed, delumped, fluidized and provided to the eductor-mixer 7 depends upon the speed at which the variable speed drive rotary feeder 35 is operating. The PLC 29 controls the vacuum break valve 16 to open it upon start-up and to close it upon shut down to avoid wetting of portions of the eductor-mixer 7 when the system is not operating. In addition, the PLC 29 is connected to the pressure sensor 12 to monitor the pressure of the working fluid. If the pressure exceeds a preset maximum, this indicates that the eductor-mixer 7 may be plugging up. If the pressure falls below a preset minimum, this indicates that pump 49 may not be operating properly. In addition, the PLC 29 is connected to the vacuum sensor 17 to monitor the vacuum. If the vacuum exceeds a preset maximum, this indicates that the eductor-mixer 7 may be plugging up. If the vacuum falls below a preset minimum, this indicates that the sugar supply may be insufficient. The PLC 29 could shut down the system or indicate an alarm if the monitored pressure or vacuum exceeds the maximum or falls below the minimum.

As shown in FIG. 2, the PLC 29 at step 202 compares the actual sugar flow rate (as measured by the mass flow meter 39) to a previously programmed set rate. If the flow rate is above the set rate, the PLC proceeds to step 204 to reduce a drive speed control signal being provided to the feeder 35.

If the flow rate is equal to or below the set rate, the PLC proceeds to step 206. If the powder flow rate is less than the set rate, the PLC proceeds to step 208 to increase the signal to the feeder 35. If the powder flow rate is not less than the set rate, then it must be equal to the set rate so that the PLC 29 proceeds to step 210 to maintain the signal which is being applied to the feeder drive. The set rate may be a single rate or a range of rates. In either event, the set rate may be manually set by an operator or may be variable and controlled by a microprocessor or the PLC 29 or other programmable logic controller which sets the rate to depend on other parameters of the system. For example, the set rate may depend upon the sugar content of the working solution 13.

As shown in FIG. 1, the tank system 21 comprises a single closed holding tank 45 having an opening in its top for receiving the discharge nozzle 15 of the eductor-mixer 7 so that solution 13 is discharged directly into a closed space to reduce the emission of dust and other materials into the surrounding environment. As will appear later in this description (see FIG. 7), the tank system 21 may include more than one tank. The level of solution in the holding tank is sensed by a tank level sensor 47 of conventional design and is controlled by the PLC 29 as noted below (see FIG. 5).

Figure 8:
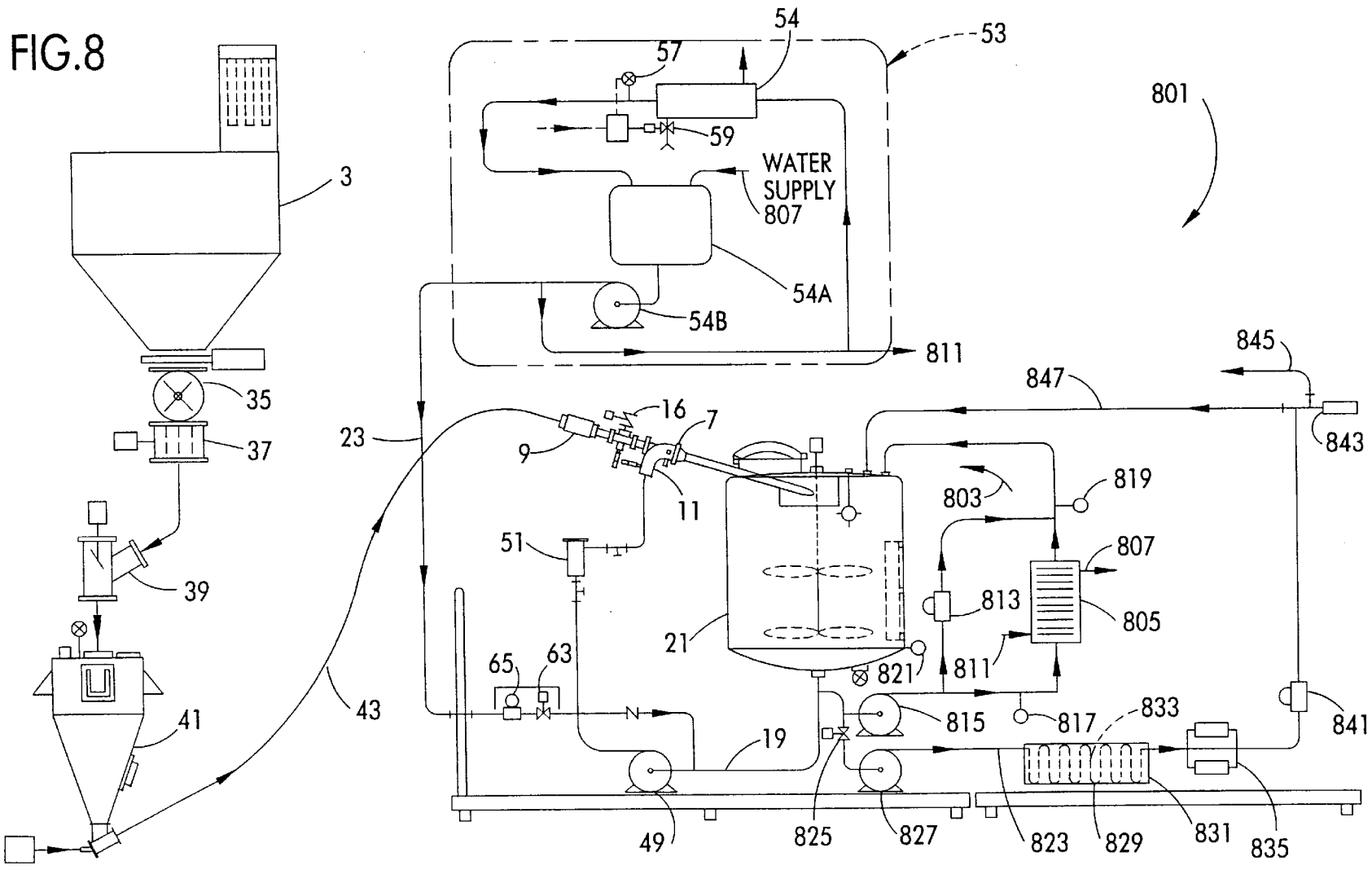
FIG. 8 is schematic view of a third preferred embodiment of a sugar liquification system of the present invention.

The working fluid circuit 18 includes a pump 49 with a variable-speed drive controlled by PLC 29 for pumping solution from the holding tank 45 through the recycle line 19 to the second inlet 11 of the eductor-mixer. A strainer 51 is provided downstream from the pump discharge for filtering the solution before it reaches the second inlet 11. The water supply line 23 is connected to the recycle line 19 on the intake side of the pump 49 so that water may be added to the solution as needed to vary the sugar concentration of the solution. Water which is added to the recycle line 19 is drawn from a cold water source and is heated by a heater system 53 in line. The heater system 53 may be of any suitable type, such as a Model BEVB by TEMA, comprising a shell and tube exchanger 54, a hot water reservoir 54A, and a pump 54B for pumping heated water from the reservoir (see FIG. 8). A heater controller 55 is responsive to the PLC 29 as described below. The heater system 53 includes a temperature sensor 57 downstream from a steam valve 59. Controller 55 opens and closes valve 59 to heat the water supplied by line 23 to a set point temperature.

Figure 3:
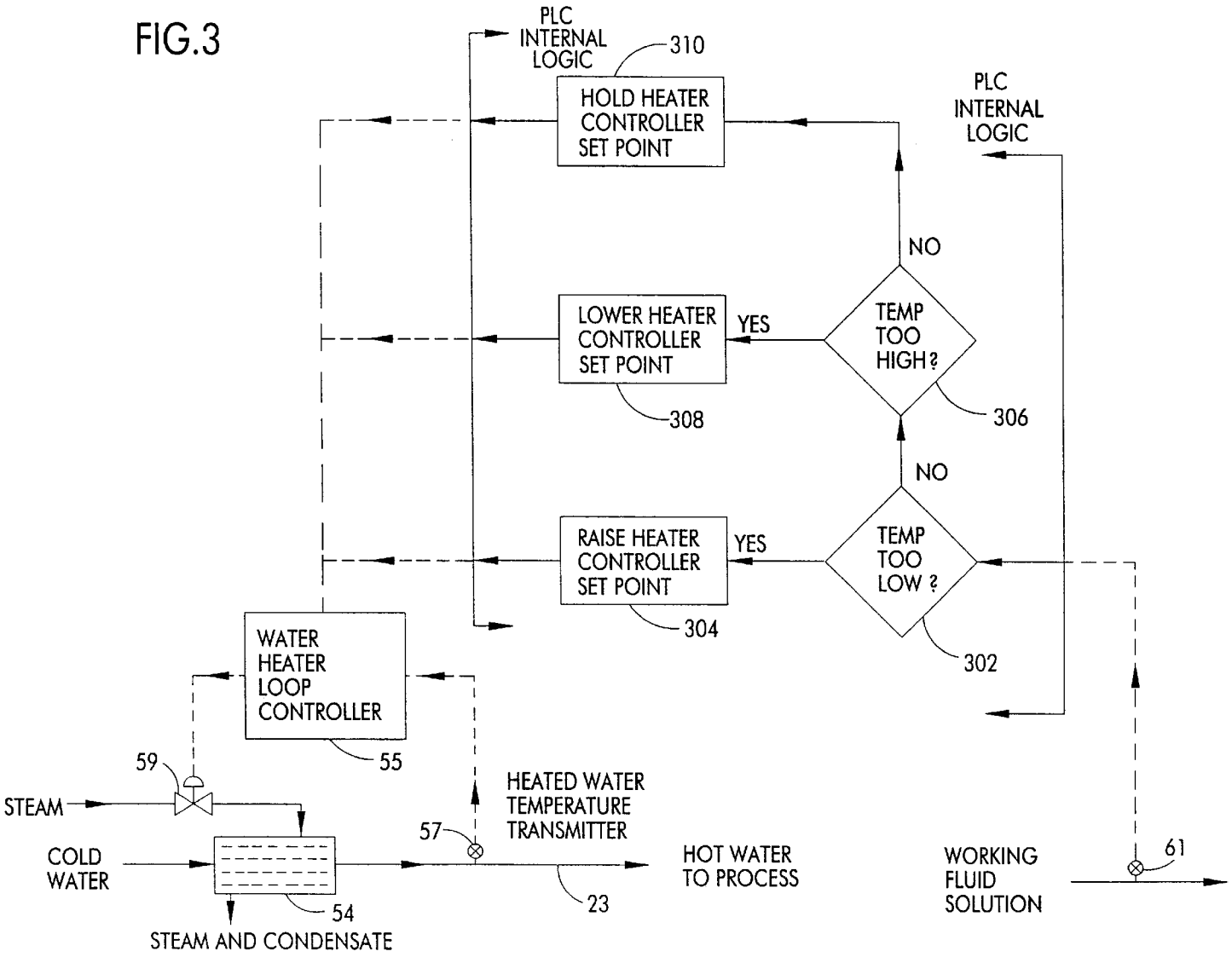
FIG. 3 is a diagram in block form illustrating one preferred embodiment of decision logic by which a controller may be programmed to control the water temperature in the system of FIG. 1 of the present invention.

FIG. 3 is a diagram in block form illustrating one preferred embodiment of the decision logic by which the PLC 29 may be programmed to control the water temperature in the system of FIG. 1. The controller 55 receives a control signal from the PLC 29 indicating the set point temperature or temperature range to which the cold water is heated. A temperature sensor 61 in the Brix circuit 25 provides a signal to the PLC corresponding to the temperature signal of the working fluid solution 13. This signal is compared at step 302 to a desired temperature or a desired temperature range for solution 13. If the solution temperature is below the desired temperature, the PLC 29 proceeds to step 304 to increase the heater controller set point which results in an increase in the heated water temperature. If the solution temperature is not below the desired temperature, the PLC proceeds to step 306. If the solution temperature is above the desired temperature, the PLC proceeds to step 308 to lower the heater controller set point. Otherwise, the solution temperature must be at the desired temperature or within the desired temperature range so that the PLC proceeds to step 310 to hold the heater controller set point.

As shown in FIG. 1., the flow rate through the water supply line 23 is controlled by a hot water flow control valve 63 and a hot water flow meter 65. The flow meter 65 is operable to measure the rate of flow through the line 23. The flow valve 63 is operable by the PLC 29 to vary the flow rate to add the appropriate amount of water to the solution recycle line 19 to obtain the desired sugar concentration.

Figure 4:
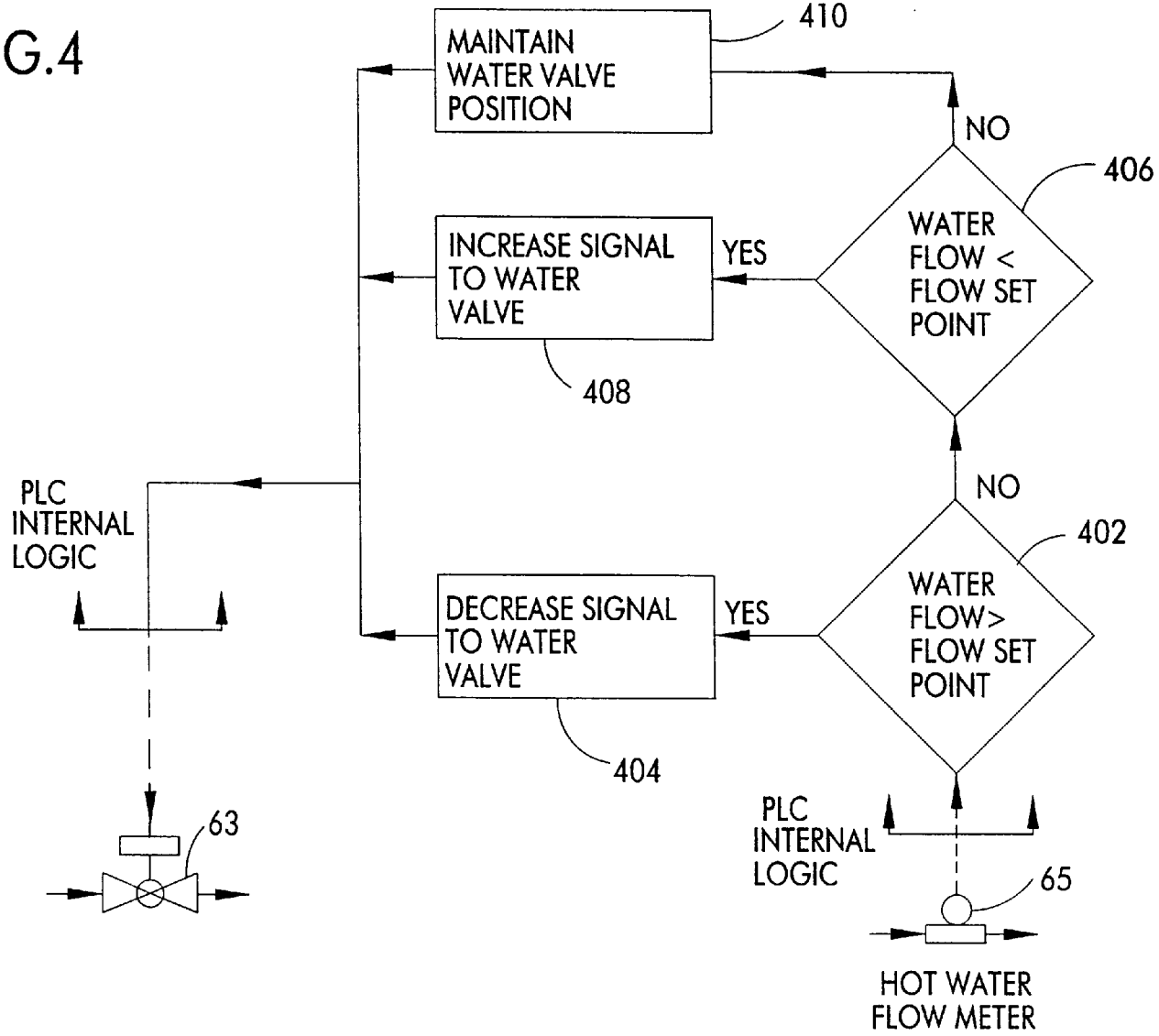
FIG. 4 is a diagram in block form illustrating one preferred embodiment of decision logic by which a controller may be programmed to control the water flow in the system of FIG. 1 of the present invention.

FIG. 4 is a diagram in block form illustrating one preferred embodiment of decision logic by which the PLC 29 may be programmed to control the water flow in the system of FIG. 1. The hot water flow meter 65 provides a signal to the PLC 29 indicating the actual hot water flow rate. At step 402, if the water flow rate is greater than a water flow set point, the PLC proceeds to step 404 to decrease the signal provided to the hot water flow control valve 63 thereby causing the valve to close and reduce the flow of hot water. The water flow rate set point needed to achieve a desired water/sugar ratio of the solution 13 is set in response to the Brix measuring device 27 and is described below with regard to FIG. 5. If the water flow rate is equal to or less than the flow set point, the PLC proceeds to step 406. If the water flow rate is less than the flow set point, the PLC proceeds to step 408 to increase the signal provided to the water valve 63 thereby opening the water valve and increasing the hot water flow rate. Otherwise, the water flow rate must be equal to the flow set point or flow set point range, in which case the PLC 29 proceeds to step 410 to maintain the water valve position.

The sugar content measuring circuit 25 of FIG. 1 includes a working solution pump 67 with a variable-speed drive responsive to PLC 29 for pumping solution 13 from the holding tank 45 through the circuit 25 and back to the tank. As noted above, the Brix measuring device 27 measures the sugar content of the solution as it passes through this circuit. Although the measuring device has been preferably described as a Brix measuring device (e.g., a Process Refractometer Model 725 available from Liquid Solids Control, Inc. of Alpton, Mass.), it may be any device which indicates sugar concentration of the working solution 13. Such devices provide a reading indicative of the Brix number or sugar/water ratio of the solution. (The Brix number represents the percentage by weight of sugar in the solution at a specified temperature. For example, a Brix reading of 67 means that the solution has a sugar content of 67% by weight at a specified temperature.) The temperature sensor 61 is provided adjacent the Brix measuring device 27 to monitor the temperature of the solution being metered.

Figure 5:
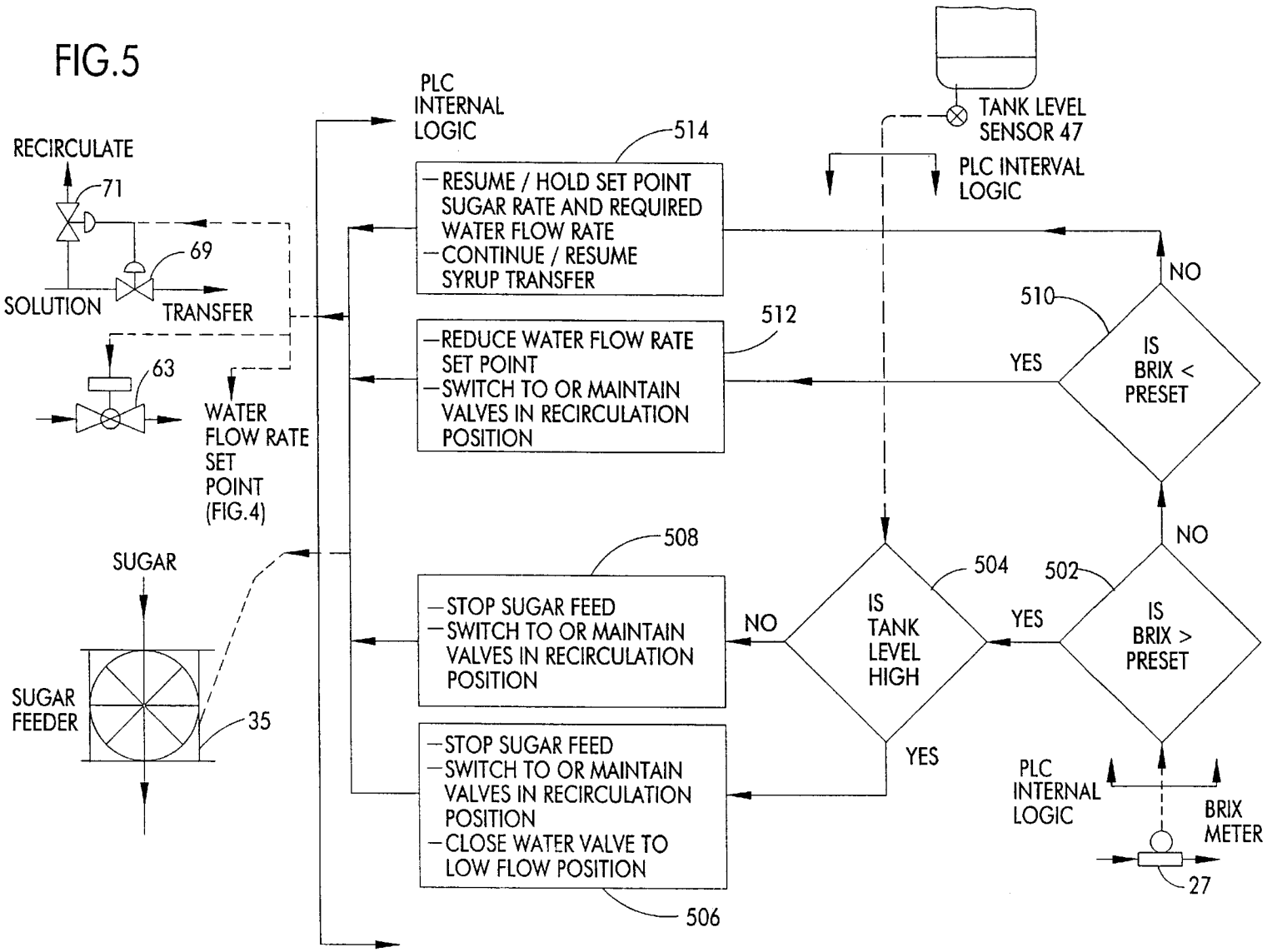
FIG. 5 is a diagram in block form illustrating one preferred embodiment of decision logic by which a controller may be programmed to control the sugar content (i.e., the Brix level) in the finished solution of the system of FIG. 1 of the present invention.

FIG. 5 is a flow diagram in block form illustrating one preferred embodiment of decision logic by which the PLC 29 may be programmed to control the target sugar content (i.e., the Brix level) in the solution 13 of the system of FIG. 1. At step 502, the PLC 29 compares the Brix level signal from the Brix meter 27 to a preset Brix level. If the Brix level of the solution is greater than the preset Brix level, the PLC proceeds to step 504 to determine the tank level. If the tank level sensor 47 is indicating that the tank level is higher than an acceptable level or range, the PLC proceeds to step 506 to discontinue sugar feeding by turning off the sugar feeder 35. In addition, finished solution (or syrup) transfer valve 69 transferring the finished syrup to the storage tanks 33 is closed and a recirculate valve 71 which permits recirculation of the working fluid solution 13 is opened. If the system is already in a recirculation mode, then step 506 maintains valves 69 and 71 in this mode. In addition, step 506 closes the hot water flow control valve 63 to its lowest flow position. Alternatively, if sensor 47 indicates that the tank level is not higher than an acceptable level, the PLC proceeds from step 504 to step 508 to discontinue sugar feeding by turning off feeder 35 and to switch or maintain the valves 69 or 71 in the recirculating position. The difference between steps 506 and 508 is that in step 508 the hot water flow control valve 63 is not closed to a minimum position since the tank level is not above an acceptable level.

If the PLC 29 determines at step 502 that the Brix level is not greater than the preset Brix level, the PLC proceeds to step 510. If the Brix level of the solution is less than the preset Brix level, the PLC proceeds to step 512 to reduce the water flow rate set point which is used by the PLC 29 in accordance with the diagram of FIG. 4. In addition, step 512 switches or maintains the valves 69 or 71 in recirculation position as described above with regard to step 506. If step 510 determines that the actual Brix level of the solution is not less than the preset Brix level, this means that the Brix level is within the set point or set point range so that the PLC 29 proceeds to step 514 to resume or hold the sugar feed rate of feeder 35 and to resume or hold the required water flow rate. In addition, step 514 continues or resumes the finished solution transfer to the storage tanks 33 by opening finished solution transfer valve 69 and closing recirculation valve 71.

It should be pointed out that step 506 and step 508 control the Brix level by controlling feeder 35 and the sugar feed rate. It is also contemplated that the sugar concentration or Brix level can be controlled by controlling only the water flow rate set point and valve 63 as illustrated in FIG. 4. It should further be pointed out that step 512 increases the Brix level by reducing the water feed rate set point. It is contemplated that the Brix level may also be increased by increasing the powder flow rate set point as employed in the sugar feed rate control loop illustrated in FIG. 2. Alternatively, a combination of both water flow rate control and sugar flow rate control employing an interaction between FIGS. 2 and 4 may be employed. In addition, both the sugar flow rate and water feed rate set points may be controlled in combination and in response to the logic of FIG. 5 in order to permit steps 506 and 508 to decrease the Brix level of the working fluid and to permit step 512 to increase the Brix level of the working fluid.

As shown in FIG. 1, the finished solution outfeed line 31 is connected to the Brix measuring circuit 25 downstream from the measuring device 27. Flow through this line is controlled by the finished solution transfer valve 69. Until the sugar concentration of the solution in the holding tank 45, as measured by the Brix measuring device 27, reaches a selected target concentration, the recirculation valve 71 remains open and the transfer valve 69 remains closed to route solution back to the tank 45 while blocking flow through the outfeed line 31. When the sugar concentration reaches (or substantially reaches) the desired target concentration, the transfer valve 69 opens to permit solution to flow through the outfeed line 31 to the storage tanks 33, and the recirculation valve 71 closes to block flow back to the holding tank 45. If the sugar concentration of the solution moves outside the target concentration, the transfer valve 69 closes and recirculation valve 71 opens to reroute solution 13 back to the tank 45 until the sugar concentration of the solution returns to the selected target. (The target concentration may be a precise concentration, e.g., Brix 67, or a range of acceptable concentrations, e.g., Brix 55–75.) The overall capacity of the holding tank 45 should be substantially greater (preferably at least about 50% greater) than the capacity needed when the system is operating within its target concentration. The additional capacity allows for any necessary adjustment of concentration, during which the level of solution in the tank will necessarily rise because the transfer valve 69 is closed.

Figure 6:
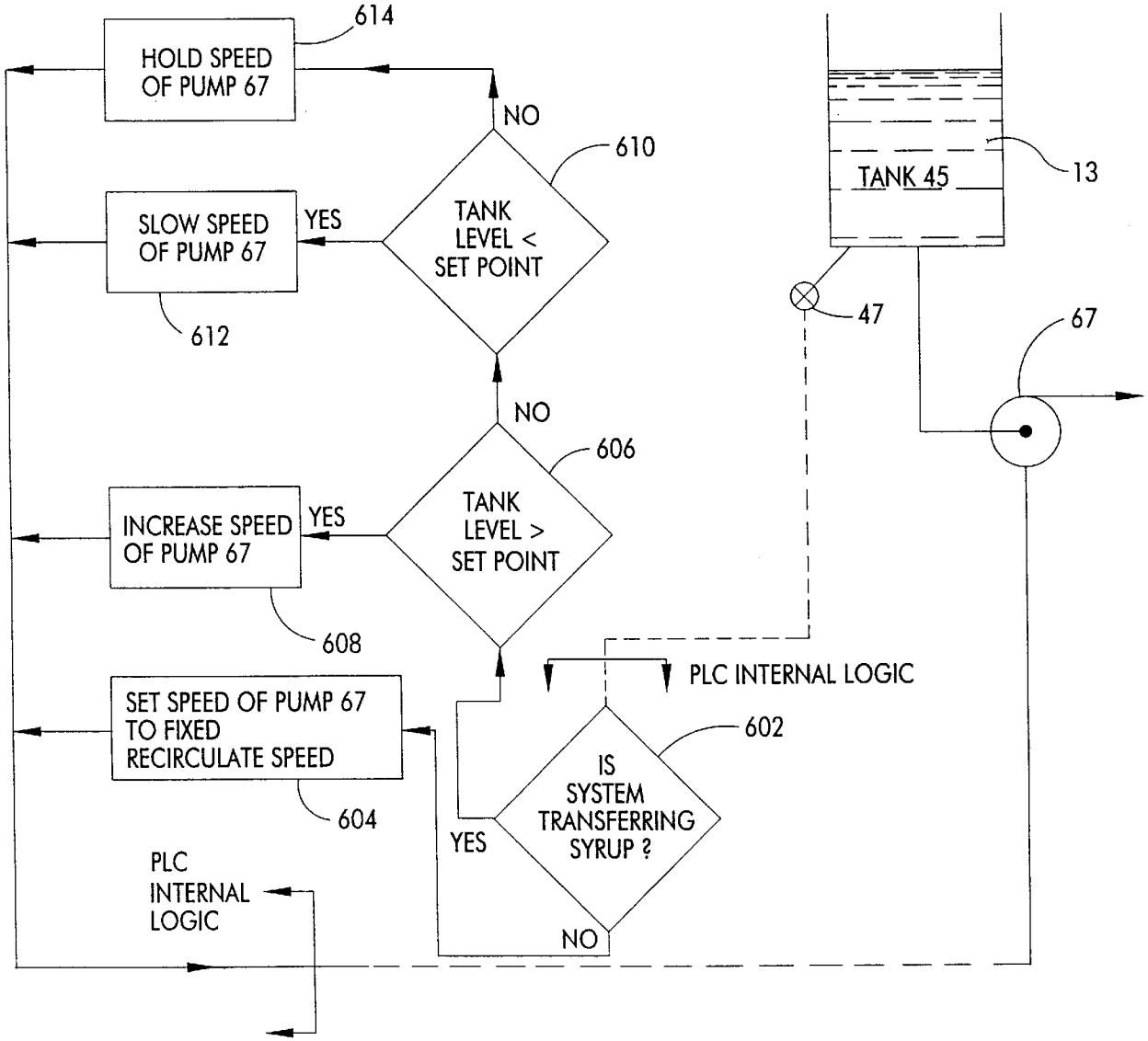
FIG. 6 is a diagram in block form illustrating one preferred embodiment of decision logic by which a controller may be programmed to control the tank level in the system of FIG. 1 of the present invention.

FIG. 6 is a diagram in block form illustrating one preferred embodiment of decision logic by which the PLC 29 may be programmed to control the level of the tank 45 in the system of FIG. 1. The tank level sensor 47 provides a signal to the PLC 29 indicating the level of solution 13 in the tank 45. At step 602, the PLC determines whether the system is in a transfer mode supplying finished solution or syrup to the storage tanks 33 or whether the system is in a recirculating mode. The mode is determined by whether or not the transfer valve 69 is open or closed. If the transfer valve 69 is closed and recirculating valve 71 is open so that finished syrup is not being provided to the storage tanks 33, the PLC proceeds to step 604 to set the speed of the working solution pump 67 to a fixed recirculate speed previously programmed into the PLC. If the system is in the transferring mode, the PLC proceeds to step 606 to compare the actual tank level as indicated by the level sensor 47 to the tank level set point. If the tank level is greater than the set point level, the PLC proceeds to step 608 to increase the speed of the working solution pump 67. If the tank level is not greater than the set point level, the PLC proceeds to step 610. If the tank level is less than the set point level, the PLC proceeds to step 612 to reduce the speed of pump 67. If the tank level is not less than the set point level, the tank level must be equal to the set point level or within a set point level range so that the PLC proceeds to step 614 to maintain the speed of pump 67.

The storage tanks 33 illustrated in FIG. 1 may be equipped with suitable valving so that the tanks fill sequentially, for example. It will be understood that finished solution can also be routed directly to a food processing area for immediate use. A recirculation valve 75 and a recirculation line 77 are provided for recirculating solution back to the holding tank (if the solution needs to be warmed, for example). This line can also be used for cleaning the system.

The eductor-mixer 7 and tank system 21 described above is preferably fabricated as a unit. To this end, the various components of this system may be mounted on a common frame, cart or skid for ease of transport. These components would include the eductor-mixer 7, the holding tank 45, and the working fluid and measuring circuits and associated pumps. For ease of use, the frame may be equipped with suitable connectors (e.g., quick-connect connectors) for connecting fluid lines on the unit to fluid lines in the facility in which the system is installed. As shown in FIG. 1, a connector 79 is used for connecting the water supply line 23 on the unit to a corresponding line from the water heater system 53, and a connector 81 is used for connecting the outfeed line 31 on the unit to a corresponding line to the storage tanks 33.

Figure 7:
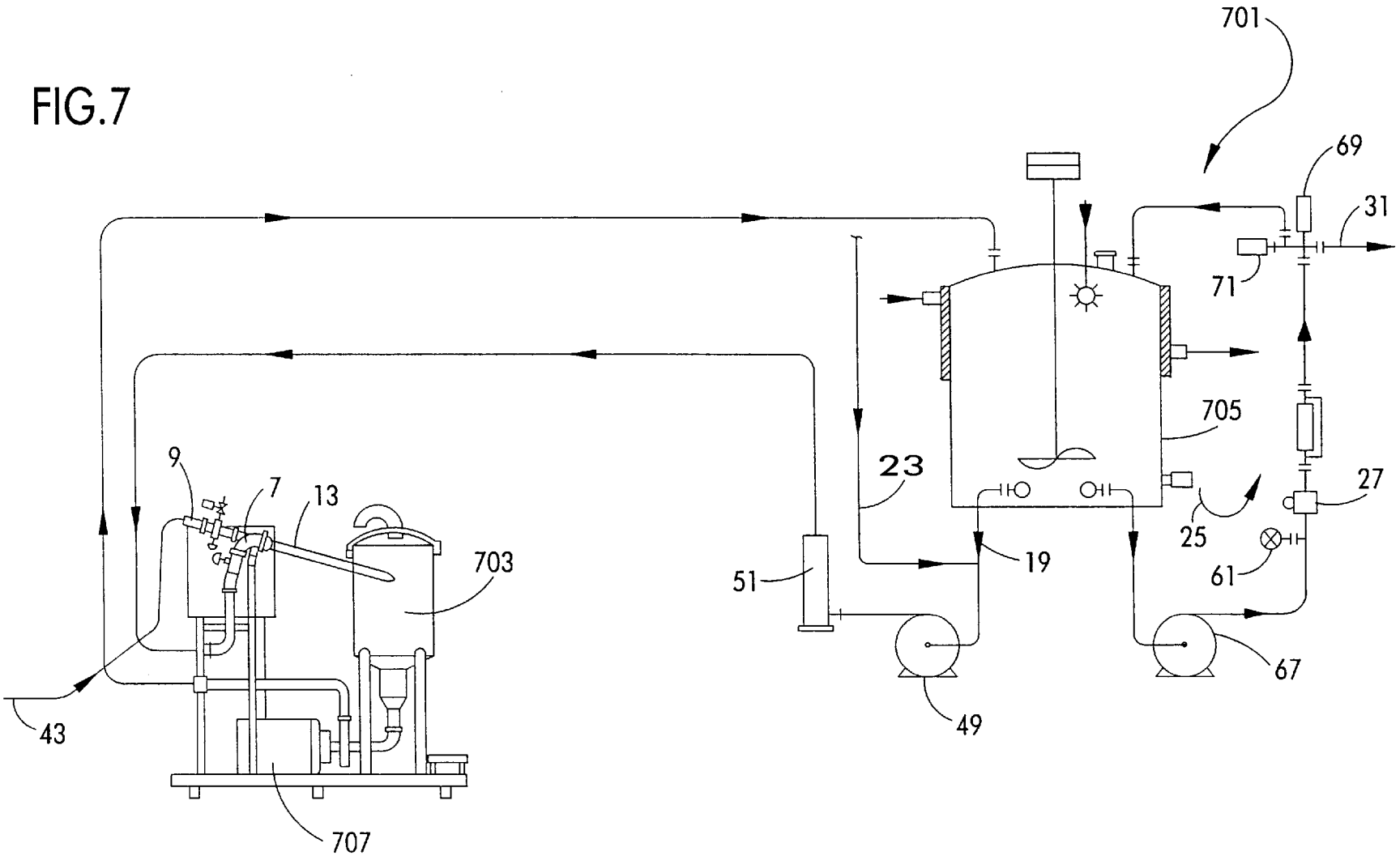
FIG. 7 is a schematic view of another preferred embodiment of a sugar liquification system of the present invention.

FIG. 7 illustrates another embodiment of the system, generally designated 701. This system is similar to the system described above and identical components are designated by the same reference numbers. System 701 differs in that the tank system includes a relatively small surge tank 703 for receiving solution discharged by the eductor-mixer 7, a holding tank 705 at a remote location, and a transfer pump 707 for pumping solution from the surge tank 703 to the holding tank 705. The surge tank 703 and transfer pump 707 may be identical in construction and operation to that disclosed in co-assigned U.S. Patent No. 5,544,951 which is incorporated herein by reference. While FIG. 7 illustrates an arrangement wherein the measuring circuit 25 is connected to the remote holding tank 705, as in the first embodiment, it will be understood that this circuit 25 could be connected to the surge tank 703 instead of the holding tank 705. The advantage of using the FIG. 7 system is that it allows the eductor-mixer 7 to be placed near the sugar feed system 5 and the holding tank 705 to be placed closer to a storage facility or food processing area.

It is contemplated that heat could be added to the system for enhancing the solubility of the sugar by means other than, or in addition to, the heater system 53 shown in FIG. 1. For example, heat could be added to the system by heating the solution in the tank system 21, or in the solution recycle line 19, or in a separate recirculation line, as described in detail hereinafter.

FIGS. 8–11 illustrate a third embodiment of the system, generally designated 801. This system is generally similar to the systems described above and identical components are designated by the same reference numbers. System 801 differs in that the solution recycle line 25 of system 1 is replaced by a solution recirculation circuit, generally designated 803, for recirculating solution from the tank system 21, and a second heater 805 in the recirculation circuit for heating solution passing through the circuit. This second heater 805 is preferably a heat exchanger connected to a suitable hot-water source, such as reservoir 54A. (Water exiting the heat exchanger 805 is routed back to the reservoir 54A via line 807.) In any event, the heater 805 should be capable of adding sufficient additional heat to the system 801 to achieve the desired solubility of the sugar in the desired solution in the desired amount of time. By way of example, the heater 805 may be sized and configured to heat the solution at a rate of 35 to 75 gallons per minute based on the requirements of the size of the system. A measuring device 813 for measuring the sugar content of the solution is provided in the recirculation circuit 803. This device 813 may be any suitable device, but is preferably a slurry density meter capable of accurately measuring the density of the sugar in the solution even in the presence of undissolved solids in the solution. A suitable density meter 813 is commercially available from Micro Motion of Boulder, Colorado. Solution is pumped through the recirculation circuit 803 by a pump designated 815. Suitable temperature gauges 817, 819 are provided upstream and downstream from the heater 805 and on the tank system 21 for indicating the temperature of the solution.

System 801 also includes a finished solution outfeed line 823 which includes a transfer valve 825 (similar to valve 69) and a pump 827 for pumping finished solution through the outfeed line to the storage tanks 33 (not shown). A solution holding device 829 may be provided in the outfeed line 823 for increasing the holding time of the solution in the line, and thus giving the sugar more time to fully dissolve, if this is necessary. This device 829 comprises a housing 831 and a length of tubing 833 bent to form a tortuous winding path through the housing which increases the "hold time" of the solution by a suitable period (e.g., 1 to 1½ minutes) for achieving total solubility. Any type of suitable holding device 829 may be used, one such device being commercially available from Semi-Bulk Systems, Inc. of St. Louis, Mo. A filter 835 is provided immediately downstream of the holding device 829 for removing all crystal seeds and other impurities from the syrup. A measuring device 841 for measuring the content of the solution is provided downstream from the filter and upstream from a transfer control valve 843. If the sugar content of the solution (as measured by device 841) is acceptable, the control valve 843 moves to an open position to allow solution to be transferred to the storage tanks 33 via line 845. If the sugar content is outside an acceptable range, the control valve 843 operates to divert the solution back to the tank system 21 via line 847. The measuring device 841 may be a Brix measuring device or meter similar to device 27 in system 1.

The sugar feed rate, water flow and tank level for system 801 may be controlled using the same logic illustrated in FIGS. 2, 4 and 6, respectively, for system 1. As explained in more detail below, FIGS. 9, 10 and 11 are flow diagrams in block form illustrating preferred embodiments of decision logic by which the PLC 29 may be programmed to control the hot water temperature, sugar concentration and transfer control valve, respectively.

Figure 9:
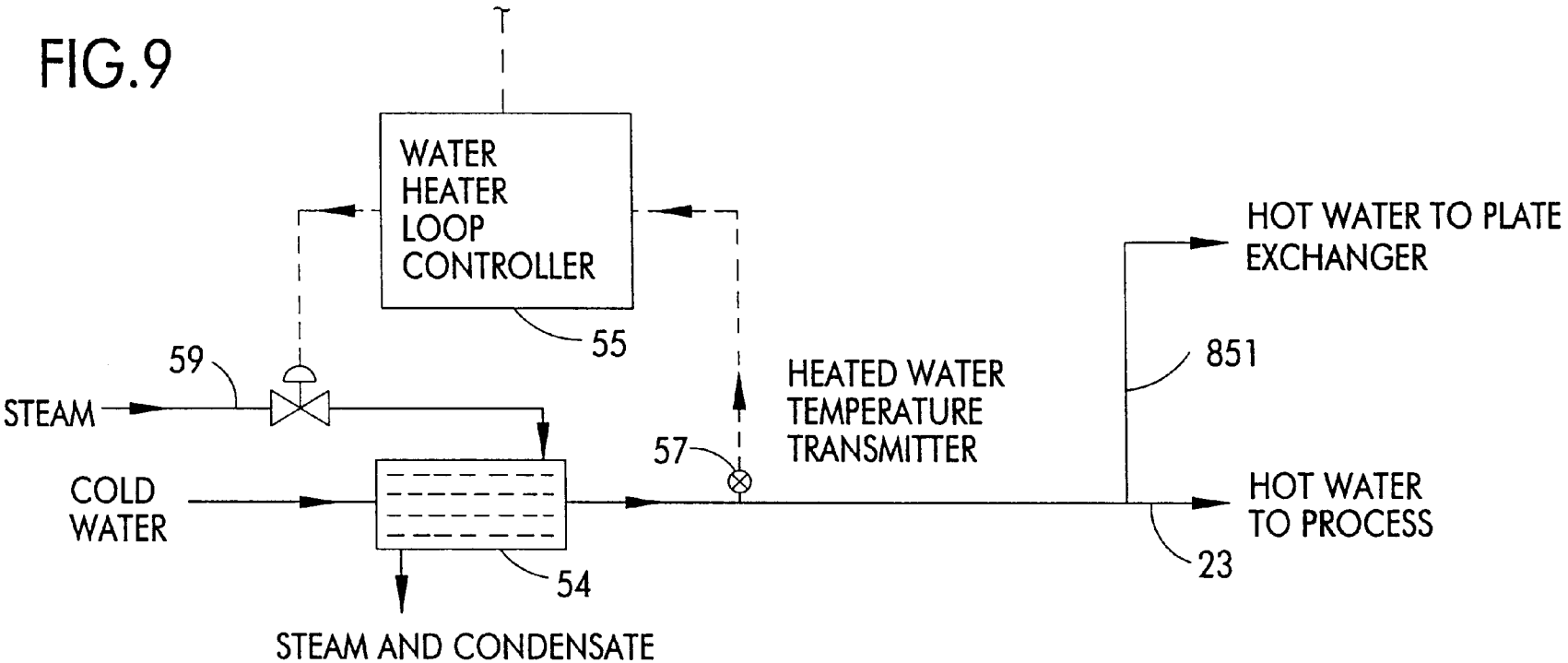
FIG. 9 is a diagram in block form illustrating one preferred embodiment by which the water temperature may be controlled in the system of FIG. 8.

The preferred hot water temperature flow control diagram for system 801 is identical to the diagram shown in FIG. 3 except for the change shown in FIG. 9 involving the addition of a separate branch line 851 for directing hot water from the heating system 53 to the plate exchanger 805.

Figure 10:
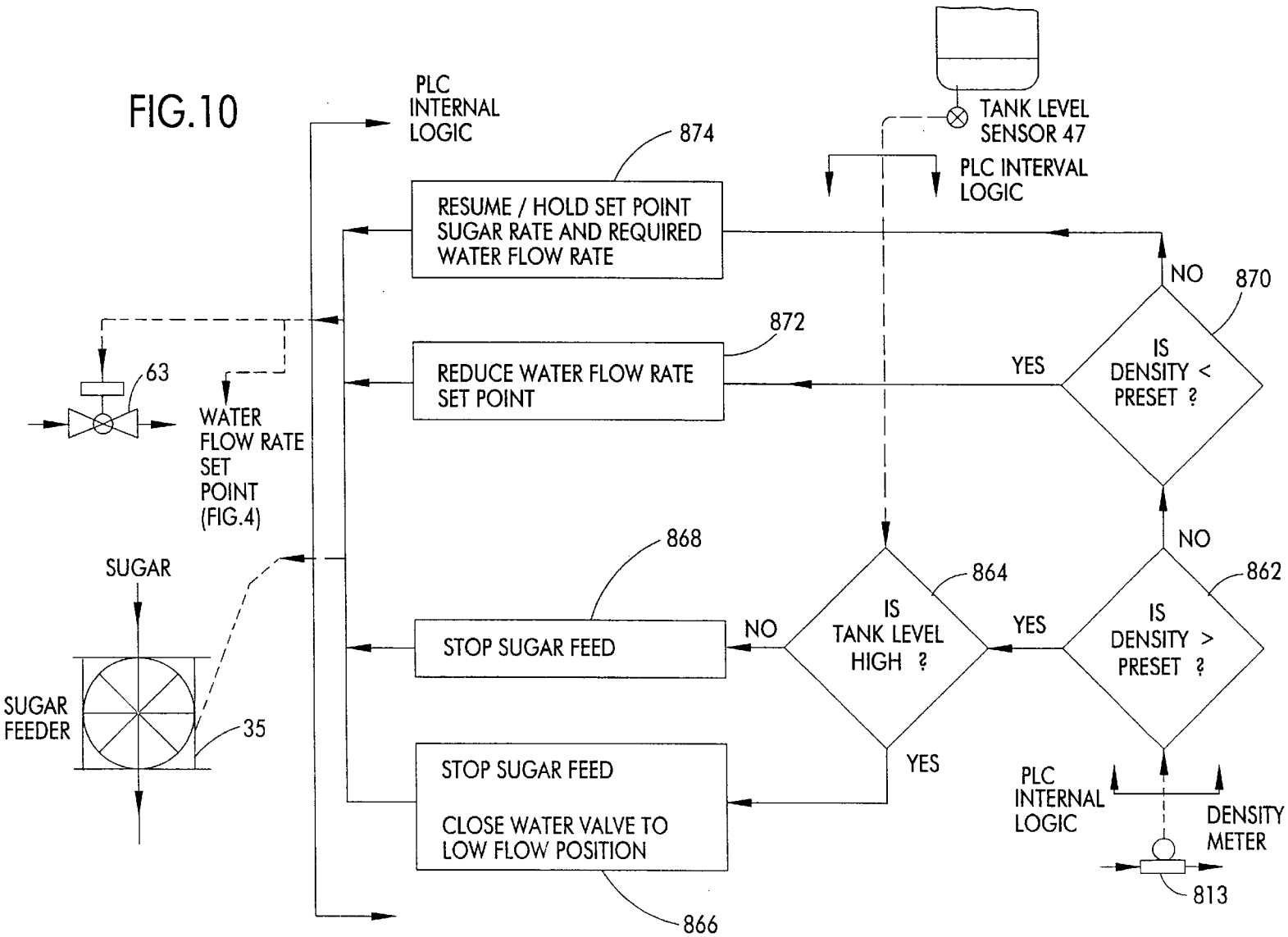
FIG. 10 is a diagram in block form illustrating one preferred embodiment of decision logic by which a controller may be programmed to control the sugar content of the solution based on measurements taken from a recirculation circuit of the system of FIG. 8.
Figure 11:
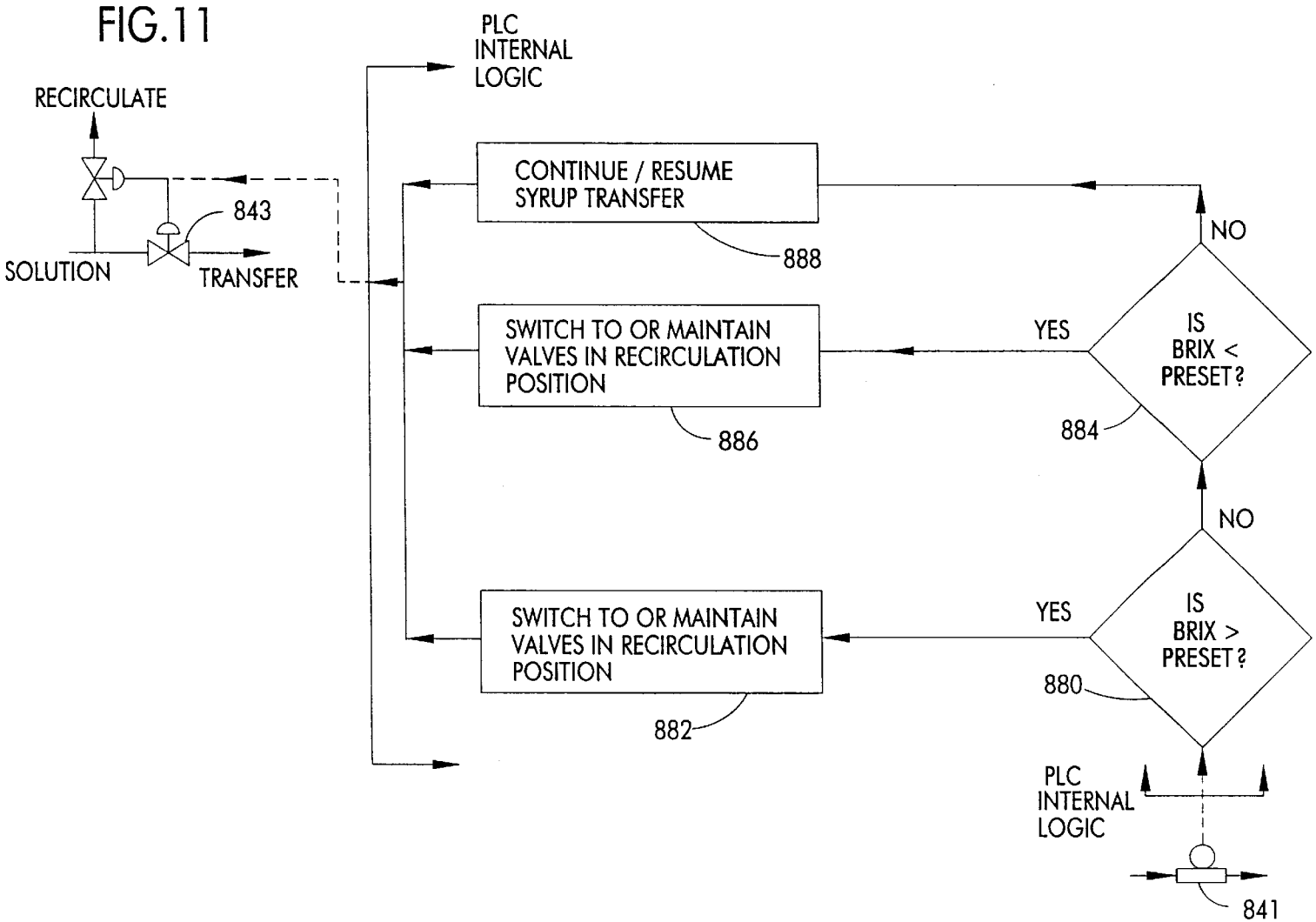
FIG. 11 is a diagram in block form illustrating one preferred embodiment of decision logic by which a controller may be programmed to control the sugar content of the finished solution based on measurements taken from a finished solution outfeed line of the system of FIG. 8.

Referring now to FIG. 10, at step 862, the PLC 29 compares the signal from the density measuring device 813 to a preset (target) density level. If the actual density level of the solution is greater than the preset density level, the PLC proceeds to step 864 to determine the tank level. If the tank level sensor 47 is indicating that the tank level is higher than an acceptable level or range, the PLC proceeds to step 866 to discontinue sugar feeding by turning off the sugar feeder 35. In addition, step 866 closes the hot water flow control valve 63 to its lowest flow position. Alternatively, if sensor 47 indicates that the tank level is not higher than an acceptable level, the PLC proceeds from step 864 to step 868 to discontinue sugar feeding by turning off feeder 35. The difference between steps 866 and 868 is that in step 868 the hot water flow control valve 63 is not closed to a minimum position since the tank level is not above an acceptable level.

If the PLC 29 determines at step 862 that the density level is not greater than the preset density level, the PLC proceeds to step 870. If the density level of the solution is less than the preset density level, the PLC proceeds to step 872 to reduce the water flow rate set point which is used by the PLC 29 in accordance with the diagram of FIG. 4. If step 870 determines that the actual density level of the solution is not less than the preset density level, this means that the density level is within the set point or set point range so that the PLC 29 proceeds to step 874 to resume or hold the sugar feed rate of feeder 35 and to resume or hold the required water flow rate.

It should be pointed out that step 866 and step 868 control the density level by controlling feeder 35 and the sugar feed rate. It is also contemplated that the sugar concentration or density level can be controlled by controlling only the water flow rate set point and valve 63 as illustrated in FIG. 4. It should further be pointed out that step 872 increases the density level by reducing the water feed rate set point. It is contemplated that the density level may also be increased by increasing the powder flow rate set point as employed in the sugar feed rate control loop illustrated in FIG. 2. Alternatively, a combination of both water flow rate control and sugar flow rate control employing an interaction between FIGS. 2 and 4 may be employed. In addition, both the sugar flow rate and water feed rate set points may be controlled in combination and in response to the logic of FIG. 10 in order to permit steps 866 and 868 to decrease the density level of the working fluid and to permit step 872 to increase the density level of the working fluid.

Referring to FIG. 11, at step 880, the PLC 29 compares the signal from the Brix measuring device to a preset (target) Brix level. If the actual Brix level of the solution in line is greater than the preset Brix level, the PLC proceeds to step 882 to switch to or maintain the transfer and control valves 825, 843 in a recirculation position for recirculating the solution through the recirculation circuit 803. If the PLC 29 determines at step 880 that the Brix level is not greater than the preset Brix level, the PLC proceeds to step 884. If the Brix level of the solution is less than the preset Brix level, the PLC proceeds to step 886 to switch to or maintain the transfer and control valves 825, 843 in a recirculation position for recirculating the solution through the recirculation circuit. If step 884 determines that the actual Brix level of the solution is not less than the preset Brix level, this means that the Brix level is within the set point or set point range so that the PLC 29 proceeds to step 888 to operate the valves 825, 843 to continue or resume syrup transfer to the storage tanks 33.

The sugar liquification system and process of this invention has significant advantages over prior systems. In the present system, after the system reaches a steady-state condition, sugar is continuously liquified to form a solution, and the solution is continuously pumped to storage or for immediate use in a food processing operation, which is much more efficient than prior "batch" systems. By using an eductor-mixer, the use of conventional sugar conveyors is eliminated, thereby avoiding cleaning and maintenance problems associated with such conveyors, and further reducing the emission of sugar particles into the air. Equipment costs are also substantially lower, and maintenance is easy since the entire system can be cleaned in place without disassembly simply by pumping a cleaning solution through the system. The system is also very flexible in that the sugar concentration of the solution can readily be varied as necessary. As noted above, the system is also easy to transport.

It will be understood that the system and process of the present invention have specific applications other than the sugar industry. For example, the invention has applications in the beverage industry where beverage ingredients (e.g., citric acid powder and carbonated water; powdered calcium and juices) may be mixed, diluted (if necessary) and then pumped directly to the filling/packaging line; in the pharmaceutical industry where powder ingredients are mixed with liquid to form a fluid mixture which can be pumped to a reactor; in the paper industry where starch powders and filler powders (e.g., titanium dioxide, calcium carbonate, clay, silica) are mixed with water for use in paper coating and filling processes; and in the food industry where slurries can be mixed and fed directly to drying operations for the processing of cereal, for example. Other possible applications include the continuous mixing of powder pigments and powder fillers with water or liquid solvents to manufacture bases for paints, inks and coatings; the continuous mixing of dairy ingredients (e.g., powder protein additives or other powder ingredients added to water or fresh milk) to form mixes which can be pumped to pasteurizing and homogenization operations; the continuous mixing of aluminum flux powder and liquid such as water to make a flux slurry which can be sprayed on heat exchangers in a controlled-atmosphere brazing process; the continuous mixing of powders (e.g., carboxyl methyl cellulose, guar gum) and water or other liquid to form thickeners; and the continuous mixing of catalyst powders (e.g., activated carbon) and liquid to form catalyst mixes which can be injected into reactors/reactions at controlled rates using a volumetric feeder, for example.

In view of the above, it will be seen that the several objects of the invention are achieved and other advantageous results attained.

As various changes could be made in the above methods and constructions without departing from the scope of the invention, it is intended that all matter contained in the above description and shown in the accompanying drawings shall be interpreted as illustrative and not in a limiting sense.

What is claimed is:

1. A sugar liquification system comprising an eductor-mixer having a first inlet for receiving dry particulate sugar from a sugar feed system, a second inlet for receiving a pressurized working liquid adapted to mix with the dry particulate sugar to form a liquified sugar solution, and a discharge adapted for discharging the solution, a tank system for receiving solution discharged from the eductor-mixer, a working fluid circuit for conducting pressurized working fluid to the second inlet of the eductor-mixer, the circuit comprising a solution recycle line for conducting solution from the tank system to the second inlet of the eductor-mixer, and a water supply line for adding water to the solution conducted to the second inlet of the eductor-mixer, a heater for adding heat to said system to increase the temperature of said solution to a temperature at or above a specified temperature, a measuring device for measuring the sugar content of said solution, a control system for automatically adjusting at least one of the following amounts if the sugar content of the solution, as measured by said measuring device, is different from a target sugar content:

(1) the amount of sugar supplied to the first inlet of the eductor-mixer; and (2) the amount of water added to the solution supplied as working fluid to the second inlet of the eductor-mixer, and a finished solution outfeed line for conducting finished solution from the tank system to a desired location when the sugar content of the solution is substantially at said target sugar content.

2. A sugar liquification system as set forth in claim 1 wherein said measuring device is disposed in a solution measuring circuit which conducts solution from the tank system to the measuring device and then back to the tank system.

3. A sugar liquification system as set forth in claim 2 wherein said measuring device is a Brix measuring device operable to measure the concentration of sugar in said solution, and wherein said sugar liquification system further comprises a temperature sensor in said solution measuring circuit for measuring the temperature of said solution, said heater being operable in response to signals from the temperature sensor to heat the water supplied via the water supply line to maintain the temperature of the solution at or above said specified temperature.

4. A sugar liquification system as set forth in claim 1 further comprising a valve for blocking the flow of solution from the tank system to the finished solution outfeed line until the sugar content of said solution, as measured by said measuring device, reaches said target sugar content whereupon the valve is operable to open to allow flow of solution from the tank system to the finished solution outfeed line.

5. A sugar liquification system as set forth in claim 1 wherein said solution recycle line is connected to the second inlet of the eductor-mixer, and wherein the water supply line is connected to said solution recycle line upstream from connection of the solution recycle line to the second inlet of the eductor-mixer.

6. A sugar liquification system as set forth in claim 1 wherein said control system comprises a flow control valve in said water supply line operable to decrease the rate of flow through the line if the sugar content of the solution, as measured by said measuring device, is less than said target sugar content.

7. A sugar liquification system as set forth in claim 6 wherein said control system is operable to slow the rate at which sugar is fed to the eductor-mixer by the sugar feed system if the sugar content of the solution, as measured by said measuring device, is greater than said target sugar content.

8. A sugar liquification system as set forth in claim 1 wherein the tank system comprises a holding tank and wherein the eductor-mixer has a discharge nozzle positioned inside the holding tank for discharging solution directly into the holding tank.

9. A sugar liquification system as set forth in claim 1 wherein the eductor-mixer is mounted on a frame, and wherein said tank system comprises a surge tank mounted on the frame for receiving solution discharged from the eductor-mixer, a holding tank remote from the frame, and a pump mounted on the frame for pumping solution from the surge tank to the holding tank.

10. A sugar liquification system as set forth in claim 1 wherein said heater is operable to heat water supplied via said water supply line.

11. A sugar liquification system as set forth in claim 10 further comprising a solution recirculation circuit separate from said working fluid circuit for recirculating solution from the tank system, and a second heater in said recirculation circuit for heating said solution.

12. A sugar liquification system as set forth in claim 11 wherein said measuring device is in said recirculation circuit.

13. A sugar liquification system as set forth in claim 12 wherein said measuring device is a density meter for measuring the density of sugar in said solution.

14. A sugar liquification system as set forth in claim 1 further comprising a solution recirculation circuit separate from the working fluid circuit for recirculating solution from the tank system, said heater being operable for heating solution flowing through said recirculation circuit.

15. A sugar liquification system as set forth in claim 14 wherein said measuring device is in said recirculation circuit.

16. A sugar liquification system as set forth in claim 15 wherein said measuring device is a density meter for measuring the density of sugar in said solution.

17. A sugar liquification system as set forth in claim 14 further comprising a solution holding device in said finished solution outfeed line for increasing the holding time of the solution in the line.

18. A sugar liquification system as set forth in claim 17 further comprising a second measuring device in said finished solution outfeed line downstream from said solution holding device for measuring the sugar content of the solution after it exits the holding device.

19. A sugar liquification system as set forth in claim 18 further comprising a transfer control valve for diverting solution in said finished outfeed line back to said tank system if the sugar content of the solution as measured by said second measuring device is below an acceptable level.

20. A sugar liquification system as set forth in claim 1 further comprising a solution holding device in said finished solution outfeed line for increasing the holding time of the solution in the line.

21. A sugar liquification system as set forth in claim 20 further comprising a second measuring device in said finished solution outfeed line downstream from said solution holding device for measuring the sugar content of the solution after it exits the holding device.

22. A sugar liquification system as set forth in claim 21 further comprising a control valve for diverting solution in said finished outfeed line back to said tank system if the sugar content of the solution as measured by said second measuring device is below an acceptable level.

23. A continuous sugar liquification process comprising the steps of:

a) continuously feeding dry particulate sugar to a first inlet of an eductor-mixer, b) continuously pumping a pressurized working fluid including water to a second inlet of the eductor-mixer to enable mixing of the working fluid and the sugar in the eductor-mixer to form a liquified sugar solution, c) delivering solution from the eductor-mixer to a tank system, d) pumping solution from the tank system through a solution measuring circuit and back to the tank system, e) measuring the sugar content of solution in said solution measuring circuit and comparing the measured sugar content of the solution to a target sugar content, f) if the measured sugar content is different from the target sugar content, automatically adjusting at least one of the following amounts to adjust the sugar content of the solution:

(1) the amount of sugar fed to the first inlet of the eductor-mixer; and (2) the amount of water in the working fluid fed to the second inlet of the eductor-mixer, and g) if the measured sugar content is substantially equal to the target sugar content, continuously conducting finished solution from the tank system to a desired location.

24. A process as set forth in claim 23 further comprising measuring the temperature of solution discharged by the eductor-mixer, comparing the temperature of the solution to a target temperature, and heating the water conveyed as a working fluid to the eductor-mixer if the temperature of the solution is less than said target temperature.

25. A process as set forth in claim 24 further comprising measuring the temperature of the solution as it passes through said solution measuring circuit.

26. A process as set forth in claim 23 further comprising continuously pumping solution from the tank system and adding water to the solution to make up the working fluid supplied to the eductor-mixer.

27. A process as set forth in claim 24 further comprising automatically decreasing the rate at which water is added to the solution making up said working fluid if the sugar content of the solution is less than said target sugar content.

28. A process as set forth in claim 23 further comprising automatically decreasing the rate at which dry particulate sugar is fed to the first inlet of the eductor-mixer if the sugar content of the solution is greater than said target sugar content.

29. A process as set forth in claim 23 further comprising automatically opening a shut-off valve to a finished solution outfeed line if the measured sugar content is substantially equal to the target sugar content, and continuously pumping finished solution from the tank system to said outfeed line.

30. A process as set forth in claim 23 wherein said tank system comprises a holding tank, and wherein step (c) comprises discharging solution from the eductor-mixer directly into the holding tank.

31. A process as set forth in claim 23 wherein said tank system comprises a holding tank and a surge tank, and wherein step (c) comprises discharging solution from the eductor-mixer into the surge tank, and then pumping solution from the surge tank to the holding tank.

32. A process as set forth in claim 23 further comprising continuously pumping solution from the tank system through a solution recirculation circuit and back to said tank system, and heating said solution as it flows through said recirculation circuit.

33. A process as set forth in claim 32 further comprising measuring the sugar content of the solution as it passes through said recirculation circuit.

34. A process as set forth in claim 33 wherein the sugar content of the solution as it passes through said recirculation circuit is measured by measuring the density of the sugar in said solution.

35. A process as set forth in claim 33 further comprising holding said finished solution from the tank system in a holding device for an interval of time before the solution is delivered to said desired location to allow sugar in the solution more time to dissolve.

36. A process as set forth in claim 35 further comprising measuring the sugar content of the finished solution downstream of said holding device, and diverting the solution back to said tank system if the measured sugar content is not within an acceptable range.

37. A process as set forth in claim 23 further comprising holding said finished solution from the tank system in a holding device for an interval of time before the solution is delivered to said desired location to allow sugar in the solution more time to dissolve.

38. A process as set forth in claim 37 further comprising measuring the sugar content of the finished solution downstream of said holding device, and diverting the solution back to said tank system if the measured sugar content is not within an acceptable range.

39. A continuous steady-state mixing system comprising an eductor-mixer having a first inlet for receiving dry particulate product from a product feed system, a second inlet for receiving a pressurized working fluid adapted to mix with the dry particulate product to form a fluid mixture, and a discharge adapted for discharging the mixture, a tank system for receiving mixture discharged from the eductor-mixer, a liquid supply line for adding a liquid to the working fluid conducted to the second inlet of the eductor-mixer, a mixture measuring circuit for conducting mixture from the tank system and then back to the tank system, a measuring device in said mixture measuring circuit for measuring the product content of said mixture, a control system for automatically adjusting at least one of the following amounts if the product content of the mixture, as measured by said measuring device, is different from a target product content:

(1) the amount of product supplied to the first inlet of the eductor-mixer; and (2) the amount of liquid supplied to the second inlet of the eductor-mixer, and a finished mixture outfeed line for conducting finished mixture from the tank system to a desired location when the product content of the mixture is substantially at said target product content.

40. A continuous steady-state mixing system as set forth in claim 39 further comprising a working fluid circuit separate from said mixture measuring circuit for conducting pressurized working fluid to the second inlet of the eductor-mixer, said working fluid circuit comprising a mixture recycle line for conducting mixture from the tank system to the second inlet of the eductor-mixer.

41. A continuous steady-state mixing system as set forth in claim 39 further comprising a valve for blocking the flow of mixture from the tank system to the finished mixture outfeed line until the product content of said mixture, as measured by said measuring device, reaches said target product content whereupon the valve is operable to open to allow flow of mixture from the tank system to the finished mixture outfeed line.

42. A continuous steady-state mixing system as set forth in claim 41 wherein said control system comprises means for controlling the rate at which product is supplied to the first inlet of the eductor-mixer, and means for controlling the rate at which said liquid is supplied.

43. A continuous steady-state mixing system as set forth in claim 39 wherein said mixture measuring circuit conducts mixture from the tank system to said measuring device and then back to said tank system without recirculation through the eductor-mixer.

44. A continuous steady-state mixing process comprising the steps of:

a) continuously feeding dry particulate product to a first inlet of an eductor-mixer, b) continuously pumping a pressurized working fluid including a liquid to a second inlet of the eductor-mixer to enable mixing of the working fluid and the dry product in the eductor-mixer to form a fluid mixture, c) delivering mixture from the eductor-mixer to a tank system, d) pumping mixture from the tank system through a product measuring circuit and back to said tank system, e) measuring the product content of mixture in said product measuring circuit and comparing the measured product content of the mixture to a target product content, f) if the measured product content is different from the target product content, automatically adjusting at least one of the following amounts to adjust the product content of the mixture:

(1) the amount of dry product fed to the first inlet of the eductor-mixer; and (2) the amount of liquid fed to the second inlet of the eductor-mixer, and g) if the measured product content is substantially equal to the target product content, continuously conducting finished mixture from the holding tank to a desired location.

45. A process as set forth in claim 44 further comprising measuring the temperature of mixture discharged by the eductor-mixer, comparing the temperature of the mixture to a target temperature, and adding heat to the mixture if the temperature of the mixture is less than said target temperature.

46. A process as set forth in claim 45 further comprising measuring the temperature of the mixture as it passes through said product measuring circuit.

47. A process as set forth in claim 44 further comprising continuously pumping mixture from the tank system and adding said liquid to the mixture to make up the working fluid supplied to the eductor-mixer.

48. A process as set forth in claim 44 further comprising automatically decreasing the rate at which said liquid is added to said working fluid if the product content of the mixture is less than said target product content.

49. A process as set forth in claim 44 further comprising automatically decreasing the rate at which dry particulate product is fed to the first inlet of the eductor-mixer if the product content of the mixture is greater than said target product content.

50. A process as set forth in claim 44 further comprising automatically opening a shut-off valve to a finished mixture outfeed line if the measured product content is substantially equal to the target product content, and continuously pumping finished mixture from the tank system to said outfeed line.

* * * * *